United States Patent [19]

Vasalos

[11] 4,404,083

[45] Sep. 13, 1983

[54] FLUID BED RETORTING PROCESS AND SYSTEM

[75] Inventor: Iacovos Vasalos, Downers Grove, Ill.

[73] Assignee: Standard Oil Company(Indiana), Chicago, Ill.

[21] Appl. No.: 293,694

[22] Filed: Aug. 17, 1981

[51] Int. Cl.[3] ..... C10G 1/00; C10B 53/06

[52] U.S. Cl. ..... 208/8 R; 208/11 R; 201/31

[58] Field of Search ..... 208/8 R, 11 R; 201/31

[56] References Cited

U.S. PATENT DOCUMENTS

| | | | |
|---|---|---|---|
| 2,582,712 | 1/1982 | Howard | 208/8 R X |
| 3,501,394 | 3/1970 | Lyons | 208/11 R |
| 3,617,468 | 11/1971 | Reyburn | 208/11 R |
| 3,703,442 | 11/1972 | Rammler et al. | 208/11 R X |
| 3,844,929 | 10/1974 | Wunderlich et al. | 208/11 R |
| 3,925,190 | 12/1975 | Whitcombe et al. | 208/11 R |
| 4,001,105 | 1/1977 | Gifford | 208/11 R |
| 4,080,285 | 3/1978 | McKinney et al. | 208/11 R X |
| 4,133,739 | 1/1979 | Mitchell et al. | 208/11 R X |
| 4,157,245 | 6/1979 | Mitchell et al. | 208/11 R X |
| 4,211,606 | 7/1980 | Ponomarev et al. | 208/11 R X |
| 4,226,699 | 10/1980 | Nutter | 208/11 R |
| 4,227,990 | 10/1980 | Dearth et al. | 208/11 R X |
| 4,243,511 | 1/1981 | Allred | 208/11 R |
| 4,293,401 | 10/1981 | Sieg et al. | 208/11 R |
| 4,318,798 | 3/1982 | Albrecht et al. | 208/11 R |
| 4,336,127 | 6/1982 | Bertelsen | 208/11 R |
| 4,336,128 | 6/1982 | Tamm | 208/11 R |

*Primary Examiner*—Delbert E. Gantz
*Assistant Examiner*—Glenn A. Caldarola
*Attorney, Agent, or Firm*—Thomas W. Tolpin; William T. McClain; William H. Magidson

[57] ABSTRACT

A fluid bed process and system for retorting hydrocarbon-containing material, such as oil shale, coal and tar sand, in which hydrocarbon-containing material and heat carrier material are fed into a mixing chamber, mixed and rapidly transported upwardly by a lift gas through a lift pipe into a solids-containing vessel to retort the hydrocarbon-containing material with minimal thermal cracking of the liberated hydrocarbons to increase the recovery of condensable hydrocarbons. The retorted material can be conveyed to a dilute phase lift pipe and combustor vessel where carbon residue in the retorted material is combusted leaving hot spent material that can be fed into the mixing chamber as heat carrier material.

12 Claims, 2 Drawing Figures

FLUID BED RETORTING PROCESS AND SYSTEM

BACKGROUND OF THE INVENTION

This invention relates to a process and system for retorting hydrocarbon-containing material, and more particularly, to a fluid bed process and system for retorting solid, hydrocarbon-containing material such as oil shale, coal and tar sand.

Researchers have now renewed their efforts to find alternate sources of energy and hydrocarbons in view of recent rapid increases in the price of crude oil and natural gas. Much research has been focused on recovering hydrocarbons from solid hydrocarbon-containing material such as oil shale, coal and tar sand by pyrolysis or upon gasification to convert the solid hydrocarbon-containing material into more readily usable gaseous and liquid hydrocarbons.

Vast natural deposits of oil shale found in the United States and elsewhere contain appreciable quantities of organic matter known as "kerogen" which decomposes upon pyrolysis or distillation to yield oil, gases and residual carbon. It has been estimated that an equivalent of 7 trillion barrles of oil are contained in oil shale deposits in the United States with almost sixty percent located in the rich Green River oil shale deposits of Colorado, Utah, and Wyoming. The remainder is contained in the leaner Devonian-Mississippian black shale deposits which underlie most of the eastern part of the United States.

As a result of dwindling supplies of petroleum and natural gas, extensive efforts have been directed to develop retorting processes which will economically produce shale oil on a commercial basis from these vast resources.

Generally, oil shale is a fine-grained sedimentary rock stratified in horizontal layers with a variable richness of kerogen content. Kerogen has limited solubility in ordinary solvents and therefore cannot be recovered by extraction. Upon heating oil shale to a sufficient temperature, the kerogen is thermally decomposed to liberate vapors, mist, and liquid droplets of shale oil and light hydrocarbon gases such as methane, ethane, ethene, propane, and propene, as well as other products such as hydrogen, nitrogen, carbon dioxide, carbon monoxide, ammonia, steam and hydrogen sulfide. A carbon residue typically remains on the retorted shale.

Shale oil is not a naturally occurring product, but is formed by the pyrolysis of kerogen in the oil shale. Crude shale oil, sometimes referred to as "retort oil," is the liquid oil product recovered from the liberated effluent of an oil shale retort. Synthetic crude oil (syncrude) is the upgraded oil product resulting from the hydrogenation of crude shale oil.

The process of pyrolyzing the kerogen in oil shale, known as retorting, to form liberated hydrocarbons, can be done in surface retorts in aboveground vessels or in situ retorts undergound. In principle, the retorting of shale and other hydrocarbon-containing materials, such as coal and tar sand, comprises heating the solid hydrocarbon-containing material to an elevated temperature and recovering the vapors and liberated effluent. However, as medium grade oil shale yields approximately 20 to 25 gallons of oil per ton of shale, the expense of materials handling is critical to the economic feasibility of a commercial operation.

In order to obtain high thermal efficiency in retorting, carbonate decomposition should be minimized.

Colorado Mahogany zone oil shale contains several carbonate minerals which decompose at or near the usual temperature attained when retorting oil shale. Typically, a 28 gallon per ton oil shale will contain about 23% dolomite (a calcium/magnesium carbonate) and about 16% calcite (calcium carbonate), or about 780 pounds of mixed carbonate minerals per ton. Dolomite requires about 500 BTU per pound and calcite about 700 BTU per pound for decomposition, a requirement that would consume about 8% of the combustible matter of the shale if these minerals were allowed to decompose during retorting. Saline sodium carbonate minerals also occur in the Green River formation in certain areas and at certain stratigraphic zones. The choice of a particular retorting method must therefore take into consideration carbonate decomposition as well as new and spent materials handling expense, product yield and process requirements.

In surface retorting, oil shale is mined from the ground, brought to the surface, crushed and placed in vessels where it is contacted with a hot heat transfer carrier, such as hot spent shale, sand or gases, or mixtures thereof, for heat transfer. The resulting high temperatures cause shale oil to be liberated from the oil shale leaving a retorted, inorganic material and carbonaceous material such as coke. The carbonaceous material can be burned by contact with oxygen at oxidation temperatures to recover heat and to form a spent oil shale relatively free of carbon. Spent oil shale which has been depleted in carbonaceous material is removed from the retort and recycled as heat carrier material or discarded. The liberated hydrocarbons and combustion gases are dedusted in electrostatic precipitators, filters, scrubbers, pebble beds, by dilution and centrifuging, or in a cyclone such as shown in U.S. Pat. Nos. 3,252,886; 3,784,462 and 4,101,412.

Some well-known processes of surface retorting are: N-T-U (Dundas Howes retort), Kiviter (Russian), Petrosix (Brazilian), Lurgi-Ruhrgas (German), Tosco II, Galoter (Russian), Paraho, Koppers-Totzek, Fushum (Manchuria), gas combustion and fluid bed. Process heat requirements for surface retorting processes may be supplied either directly or indirectly.

Directly heated surface retorting processes, such as the N-T-U, Kiviter, Fusham and gas combustion processes, rely upon the combustion of fuel, such as recycled gas or residual carbon in the spent shale, with air or oxygen within the bed of shale in the retort to provide sufficient heat for retorting. Directly heated surface retorting processes usually result in lower product yields due to unavoidable combustion of some of the products and dilution of the product stream with the products of combustion. The Fusham process is shown and described at pages 101–102, in the book *Oil Shales and Shale Oils,* by H. S. Bell, published by D. Van Norstrand Company (1948). The other processes are shown and described in the *Synthetic Fuels Data Handbook,* by Cameron Engineers, Inc. (second edition, 1978).

Indirectly heated surface retorting processes, such as the Petrosix, Lurgi-Ruhrgas, Tosco II and Galoter processes, utilize a separate furnace for heating solid or gaseous heat-carrying material which is injected, while hot, into the shale in the retort to provide sufficient heat for retorting. In the Lurgi-Ruhrgas process and some other indirect heating processes, raw oil shale or tar sand and a hot heat carrier, such as spent shale or sand, are mechanically mixed and retorted in a screw conveyor. Such mechanical mixing often results in high temperature zones conducive to undesirable thermal cracking as well as causing low temperature zones which result in incomplete retorting. Furthermore, in such processes, the solids gravitate to the lower portion of the vessel, stripping the retorted shale with gas causing lower product yields due to reabsorption of a portion of the evolved hydrocarbons by the retorted solids. Generally, indirect heating surface retorting processes result in higher yield and less dilution of the retorting product than directly heated surface retorting processes, but at the expense of additional materials handling.

Surface retorting processes with a moving bed are typified by the Lurgi coal gasification process in which crushed coal is fed into the top of a moving bed gasification zone and upflowing steam endothermically reacts with the coal. A portion of the char combusts with oxygen below the gasification reaction zone to supply the required endothermic heat of reaction. Moving bed processes are disadvantageous because the solids residence time is usually long, necessitating either a very large contacting or reaction zone or a large number of reactors. Moreover, moving bed processes often cannot tolerate excessive amounts of fines.

Surface retorting processes with entrained beds are typified by the Koppers-Totzek coal process in which coal is dried, finely pulverized and injected into a treatment zone along with steam and oxygen. The coal is rapidly partially combusted, gasified, and entrained by the hot gases. Residence time of the coal in the reaction zone is only a few seconds. Entrained bed processes are disadvantageous because they require large quantities of hot gases to rapidly heat the solids and often require the raw feed material to be finely pulverized before processing.

Fluid bed surface retorting processes are particularly advantageous. The use of fluidized-bed contacting zones has long been known in the art and has been widely used in fluid catalytic cracking of hydrocarbons. When a fluid is passed at a sufficient velocity upwardly through a contacting zone containing a bed of subdivided solids, the bed expands and the particles are buoyed and supported by the drag forces caused by the fluid passing through the interstices among the particles. The superficial vertical velocity of the fluid in the contacting zone at which the fluid begins to support the solids is known as the "minimum fluidization velocity." The velocity of the fluid at which the solid becomes entrained in the fluid is known as the "terminal velocity" or "entrainment velocity." Between the minimum fluidization velocity and the terminal velocity, the bed of solids is in a fluidized state and it exhibits the appearance and some of the characteristics of a boiling liquid. Because of the quasi-fluid or liquid-like state of the solids, there is typically a rapid overall circulation of all the solids throughout the entire bed with substantially complete mixing, as in a stirred-tank reaction system. The rapid circulation is particularly advantageous in processes in which a uniform temperature and reaction mixture is desired throughout the contacting zone.

Typifying those prior art fluidized bed retorting processes, fluid catalytic cracking processes, and similar processes are the Union Carbide/Battelle coal gasification process, the fluid coker and flexicoking processes described at page 300 of the *Synthetic Fuels Data Handbook*, by Cameron Engineers, Inc. (second edition, 1978) and those found in U.S. Pat. Nos. 2,471,119; 2,506,307; 2,518,693; 2,608,526; 2,657,124; 2,684,931; 2,793,104; 2,799,359; 2,807,571; 2,844,525; 3,039,955; 3,152,245; 3,281,349; 3,297,562; 3,501,394; 3,617,468; 3,663,421; 3,703,052; 3,803,021; 3,803,022; 3,855,070; 3,976,558; 3,980,439; 4,052,172; 4,064,018; 4,087,347; 4,110,193; 4,125,453; 4,133,739; 4,137,053; 4,141,794; 4,148,710; 4,152,245; 4,157,245; 4,183,800; 4,199,432. These prior art processes have met with varying degrees of success.

Prior art gas fluidized bed processes usually have a dense particulate phase and a bubble phase, with bubbles forming at or near the bottom of the bed. These bubbles generally grow by coalescence as they rise through the bed. Mixing and mass transfer are enhanced when the bubbles are small and evenly distributed throughout the bed. When too many bubbles coalesce so that large bubbles are formed, a surging or pounding action results, leading to less efficient heat and mass transfer.

A problem with many prior art fluidized bed processes is the long residence time at high temperatures which results in many secondary and undesirable side reactions such as thermal cracking, which usually increases the production of less desirable gaseous products and decreases the yield and quality of desirable condensable products. Therefore, in any process designed to produce the maximum yield of high quality condensable hydrocarbons, it is preferred that the volatilized hydrocarbons are quickly removed from the retorting vessel in order to minimize deleterious side reactions such as thermal cracking.

Another problem with many prior art processes, particularly with countercurrent fluidized bed flow processes, is that after the shale oil has been vaporized, it then comes in contact with countercurrent flowing solids which are at a much cooler temperature, which leads to condensation of a portion of the shale oil and reabsorption of a portion of the vaporized shale oil into the downward flowing shale. This condensation and reabsorption leads to coking, cracking and polymerization reactions, all of which are detrimental to producing the maximum yield of condensable hydrocarbons.

It is therefore desirable to provide an improved fluid bed retorting process and system which overcomes most, if not all, of the preceding problems.

SUMMARY OF THE INVENTION

A fluid bed retorting process and system is provided which minimizes thermal cracking of liberated hydrocarbons during retorting to maximize the yield of condensable hydrocarbons. The novel process and system is particularly useful in producing synthetic fuels from oil shale, coal and tar sand because it avoids the use of most equipment and machinery with complex moving parts whose through-put capacity is typically limited and which have a tendency to clog, break down or malfunction.

In the novel process, raw fluidizable, retortable, solid hydrocarbon-containing material, such as oil shale, coal or tar sand, is mixed with hot fluidizable, solid, heat carrier material, such as spent shale or sand, in a mixing chamber and rapidly transported upwardly through a lift pipe into a solids-containing vessel. Retorting of the raw hydrocarbon-containing material commences in the mixing chamber, continues in the lift pipe and is completed in the solids-containing vessel with minimal thermal cracking of the liberated hydrocarbons. The retorting temperature is selected by introducing the heat carrier material into the mixing chamber at a temperature sufficient to liberate hydrocarbons contained in the raw hydrocarbon-containing material with minimal carbonate decomposition. The retorting residence time is controlled by injecting a lift gas into the mixing chamber at a flow rate and pressure to fluidize, entrain, and rapidly transport the admixture through the mixing chamber and lift pipe with minimal thermal cracking of the liberated hydrocarbons. The fluidized admixture gravitates downwardly to a solids discharge outlet for a sufficient residence time in the solids-containing vessel to complete retorting of the raw hydrocarbon-containing material without thermal cracking a substantial amount of the liberated hydrocarbons.

The retorted hydrocarbon-containing material and the heat carrier material are discharged from the solids discharge outlet and the liberated hydrocarbons and the lift gas are withdrawn from an upper portion of the solids-containing vessel for further processing or recycling. Some of the discharged light hydrocarbon gases can be recycled for use as the lift gas. Combusted, retorted, hydrocarbon-containing material, such as spent shale or sand can be used as the heat carrier material.

As used throughout this application, the term "retorted" hydrocarbon-containing material or "retorted" shale refers to hydrocarbon-containing material or oil shale, respectively, which has been retorted to liberate hydrocarbons leaving a material containing carbon residue.

The term "spent" hydrocarbon-containing material or "spent" shale as used herein means retorted hydrocarbon-containing material or shale, respectively, from which essentially all of the carbon residue has been removed by combustion.

The terms "condensable," "condensed," "noncondensable," "normally gaseous" or "normally liquid" are relative to the condition of the subject material at a temperature of 77° F. (25° C.) and a pressure of one atmosphere.

While the above process can be carried out in various size vessels and with various equipment, it is preferred that the above process be carried out in a system in which the mixing chamber has a cross-sectional area which is substantially greater than the cross-sectional area of the lift pipe, taken in a direction transverse to the upward flow of lift gas and in which raw hydrocarbon-containing material and hot heat carrier material are separately fed into the mixing chamber.

A more detailed explanation of the invention is provided in the following description and appended claims taken in conjunction with the accompanying drawings.

DETAILED DESCRIPTION OF THE PREFERRED EMBODIMENT

Figures 1, 2:
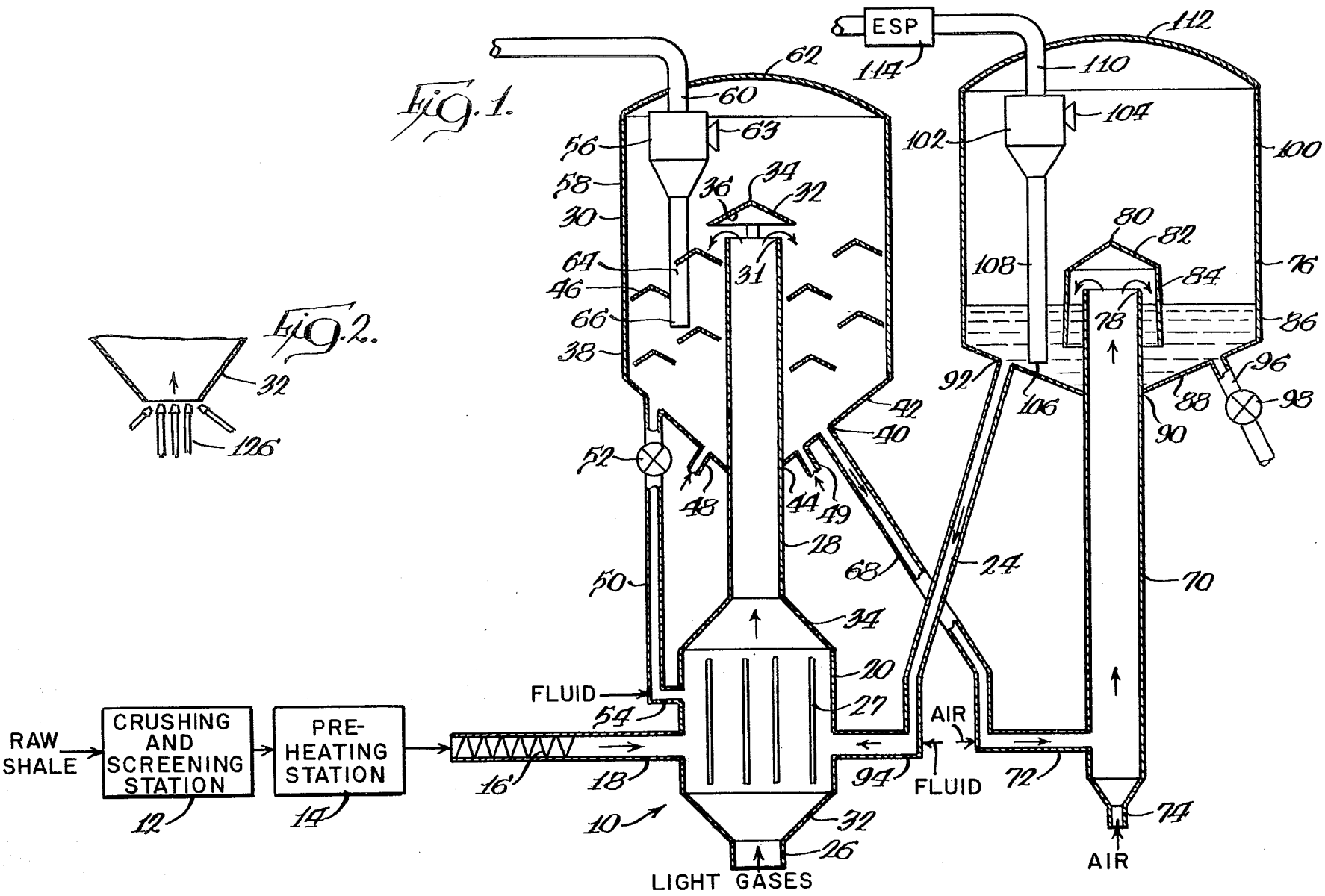
FIG. 1 is a schematic flow diagram of a fluid bed retorting process and system in accordance with principles of the present invention.
FIG. 2 is a cross-sectional view of injector nozzles for use in the fluid bed retorting process and system.

Referring now to FIG. 1, a fluid bed process and system 10 is provided to retort hydrocarbon-containing material, such as oil shale, coal, tar sand, uintaite (gilsonite), lignite and peat, for use in making synethetic fuels. While the process of the present invention is described hereinafter with particular reference to the processing of oil shale, it will be apparent that the process can also be used to retort other hydrocarbon-containing materials such as coal, tar sand, uintaite (gilsonite), lignite, peat, etc.

In process and system 10, raw oil shale is fed to a crushing and screening station 12. The oil shale should contain an oil yield of at least 15 gallons per ton of shale particles in order to make the process and system self-sustaining in terms of energy requirements, so that the lift gas consists essentially of liberated light hydrocarbons from the system and the heat carrier material consists essentially of spent oil shale from the system.

At the crushing and screening station 12, raw oil shale is crushed and sized to a maximum particle size of 3 mm, so as to be fluidizable, by conventional crushing equipment such as a jaw crusher, gyratory crusher or roll crusher and by conventional screening equipment such as a shaker screen or vibrating screen. Oil shale particles over 3 mm should be avoided, if possible, because they do not attain the desired lift velocity for effective retorting.

The crushed oil shale particles are conveyed to a preheating station 14 where the shale is preheated to between ambient temperature and 700° F. to dry off most of the moisture contained in the shale. Preferably, the crushed oil shale particles are preheated to a temperature from 250° to 600° F., and most preferably, from 300° to 400° F. Oil shale temperatures over 700° F. should be avoided at this stage because they may cause premature retorting. The preheating station 14 and the crushing and screening station 12 can be combined, if desired.

The preheated, crushed oil shale particles are conveyed by a screw conveyor 16 or other conveying means such as a lift elevator, gravity flow from a lock hopper or conventional fluid conveying means, through a feed pipe 18 into a mixing chamber 20, which is sometimes referred to as an "ejector" or "mixing zone." The crushed oil shale particles are fed into mixing chamber 20 at a solids flux flow rate between 5,000 and 100,000 lbs/ft$^2$ hr, and preferably between 10,000 and 50,000 lbs/ft$^2$ hr. A solids flux flow rate over 100,000 lbs/ft$^2$ hr should be avoided because retorting efficiency is reduced.

Heat carrier material, preferably, spent oil shale from the system having a particle size similar to the oil shale particles so as to be fluidizable, is fed through a heat carrier pipe 24 into mixing chamber 20 at a temperature from 1000° F. to 1400° F., preferably from 1100° F. to 1300° F., and, most preferably, from 1150° to 1250° F. Heat carrier material in excess of 1400° F. should not be fed into the mixing chamber because it will decompose substantial quantities of carbonates in the oil shale. Heat carrier material below 1000° F. should not be fed into the mixing chamber, if possible, because fine removal problems are aggravated and heat carrier input requirements are increased because of the high attrition rates at high recycle ratios.

The ratio of the solids flux flow rate of the heat carrier material (spent shale) being introduced into mixing chamber 20 to the solids flux flow rate of raw shale in lbs/ft$^2$ hr is in the range of from 3:1 to 10:1, and preferably, from 4:1 to 5:1.

The influent rate of the raw oil shale particles and spent shale being fed into mixing chamber 20 is sufficient to mix the oil shale particles and spent shale together in the mixing chamber so that the hot spent shale directly contacts and heats the raw oil shale particles to commence partial retorting of the raw oil shale particles in mixing chamber 20. The hydrocarbons liberated during retorting are emitted as a gas, vapor, mist or liquid droplets and most likely, a mixture thereof. A series of vertical metal bars 27 can also be positioned in the interior of mixing chamber 20 to promote mixing and heat transfer as well as to break bubbles and reduce slugging that may result during retorting.

A fluidizing lift gas, such as recycled light hydrocarbon gases from the system, is injected by a lift gas injector or gas tube 26 into the bottom of mixing chamber 20 at a temperature between ambient temperature and 1000° F., preferably from 500° F. to 700° F., at a pressure from 30 to 100 psig, preferably at a maximum of 40 psig, and at a velocity of from 50 ft/sec to 200 ft/sec, preferably at a maximum of 100 ft/sec. A lift gas injection velocity of over 200 ft/sec should be avoided because it has a tendency to break apart the oil shale particles. A lift gas injection velocity below 50 ft/sec will not provide enough lift for the oil shale particles. The lift gas should not contain a sufficient amount of molecular oxygen to support combustion. In other words, a molecular oxygen, combustion-supporting gas, such as air, should be avoided as a lift gas in the mixing chamber because it could undesirably combust liberated oil in the mixing chamber as well as in lift pipe 28 and solids-containing vessel 30.

In the preferred embodiment, the lift gas is supplied by recycled, light hydrocarbon gases that have been discharged from the fluidized bed-containing vessel 30 and contains carbon dioxide, hydrogen, methane, $C_2$ and other light hydrocarbons. Preferably, the lift gas contains 10 to 30% $CO_2$ and most preferably, between 15 and 20% $CO_2$. At least 10% carbon dioxide is needed to effectively suppress carbonate decomposition in the retorting process.

Combustion of the raw oil shale particles and liberated hydrocarbons is prevented in mixing chamber 20 and lift pipe 28 by preventing an amount of molecular oxygen sufficient to support combustion from entering the mixing chamber and lift pipe.

The injection pressure and flow rate of the lift gas into mixing chamber 20 is sufficient to enhance turbulent mixing of the raw oil shale particles and spent shale as well as to fluidize, entrain, propel and convey the admixture and liberated hydrocarbons upwardly through the mixing chamber 20 and a verticle lift pipe 28 into an upper solids-containing collection vessel 30. The superficial upward velocity of the lift gas in mixing chamber 20 is in the range from 2.0 ft/sec to 4.5 ft/sec, preferably from 3.5 ft/sec to 4 ft/sec. The retorting temperature in the mixing chamber is in the range from 900° F. to 1200° F., preferably from 975° F. to 1050° F., and most preferably at 1025° F. The retorting pressure in the mixing chamber is from 30 psig to 50 psig and preferably at a maximum of 40 psig. The retorting temperature and pressure in the mixing chamber are generally uniform, except in proximity to the inlets and outlets.

The solids residence time of the raw oil shale particles and spent shale in mixing chamber 20 is in the range from 10 to 60 seconds, preferably between 20 and 50 seconds, and most preferably not greater than 30 seconds. The gas residence time of the lift gas and liberated hydrocarbons in mixing chamber 20 is between 0.5 and 5.0 seconds, and preferably at a maximum of 2.5 seconds. A solids residence time of over 60 seconds in the mixing chamber 20 causes an undesirable amount of cracking of the liberated hydrocarbons. A solids residence time of less than 20 seconds in the mixing chamber is too short for effective retorting.

In order to enhance mixing, retorting, entrainment and throughput while minimizing thermal cracking of the liberated hydrocarbons, mixing chamber 20 has a maximum cross-sectional area substantially greater than the maximum cross-sectional area of lift pipe 28 taken in a widthwise (horizontal) direction, transverse to the upward flow of lift gas. Preferably, the ratio of the maximum cross-sectional areas of mixing chamber 20 to lift pipe 28 is from 1.3:1 to 15:1, and most preferably about 3:1. The ratio of the height (length) of mixing chamber 20 to the diameter of mixing chamber 20 is from 1:1 to 10:1. Mixing chamber 20 has an upwardly diverging, frustroconical wall portion 32 adjacent lift gas injector tube 26 and an upwardly converging frustro-conical wall portion 34 adjacent lift pipe 28 to attain a more uniform flow pattern and pressure charge.

The ratio of the cross-sectional area of mixing chamber 20 to the total cross-sectional area of the lift gas injector tube 26, taken in a widthwise (horizontal) direction transverse to the upward flow of lift gas is from 2.5:1 to 20:1, and preferably 5:1.

Lift pipe 28, which is sometimes referred to as a "vertical riser reactor," extends into the solids-containing vessel 30. The upward velocity of the lift gas and liberated hydrocarbons in lift pipe 28 is in the range from 20 ft/sec to 100 ft/sec, preferably 30 ft/sec to 50 ft/sec, and most preferably at least 40 ft/sec to transport the raw oil shale particles. The gas residence time of the lift gas and liberated hydrocarbons in lift pipe 28 is in the range from 1 second to 5 seconds and preferably at a maximum of 3 seconds. The density of the solids admixture in lift pipe 28 is in the range from 3 lbs/ft$^3$ to 20 lbs/ft$^3$ and preferably from 5 lbs/ft$^3$ to 10 lbs/ft$^3$.

The bottom 42 of the solids-containing vessel is welded or otherwise secured to the middle portion of lift pipe 28. Solids-containing vessel 30 has a centrally disposed, lift pipe-receiving opening 44 at its bottom end to permit the lift pipe 28 to extend upwardly into the solids-containing vessel 30. The ratio of the maximum cross-sectional area of the solids-containing vessel 30 to the maximum cross-sectional area of mixing chamber 20 taken in a horizontal direction is in the range of 2:1 to 10:1, and preferably 5:1.

The upper free-standing, unattached outlet 31 of lift pipe 28 is spaced slightly below a conical baffle 32 whose apex 34 is in axial alignment with the vertical axis of lift pipe 28. The downwardly facing surfaces 36 of conical baffle 32 direct and deflect the solids admixture as well as the lift gas and liberated hydrocarbons downwardly towards the lower portion 38 of the solids-containing vessel 30.

The solids admixture moves downwardly by gravity flow in the lower portion 38 of vessel 30 for a sufficient residence time to complete retorting of the raw oil shale particles. The solids residence time of the oil shale particles and spent shale in the solids-containing vessel 30 is from 1 to 20 minutes, and preferably at a maximum of 3 minutes to attain the desired results. The downwardly converging, sloping bottom wall 42 of vessel 30 facilitates downward flow of the solids admixture to solids discharge outlet 40.

An array of conical baffles 46 is staggered in the lower portion 38 of vessel 30 to facilitate downward plug flow and minimize backflow of the solids admixture in the lower portion 38 of vessel 30. The underside of the conical baffles 46 provides an upward barrier against backflow. The top surfaces of the conical baffles 46 slope downwardly to direct the solid agglomerates downwardly to minimize the formation of clusters.

Steam injectors 48 and 49 can be provided to inject steam into the bottom 42 of the solids-containing vessel 30 to partially fluidize the solids admixture and enhance downward plug flow. The steam causes staged, downward flow of the solids admixture in the vessel's lower portion 38 to provide a staged fluidized bed. The upward velocity of the steam injected into vessel 30 is from 0.2 ft/sec to 3 ft/sec, and preferably at a maximum of 2 ft/sec. Conical baffles 46 help break up bubbles that may be emitted during the injection of steam at high rates.

An optional return pipe 50 extends downward from the lower portion 38 of vessel 30 to mixing chamber 20 for return of the solids admixture for further retorting, if desired. The outlet end of return pipe 50 has an L valve 54 into which a fluid can be injected to help transport the returned solids into mixing chamber 20. Shutoff valve 52 regulates the return flow of the solids through return pipe 50.

The effluent product stream of liberated hydrocarbons admixed with lift gas and steam rises to the upper portion 58 of the solids-containing vessel 30 and is dedusted by dedusting equipment, such as cyclones. In the preferred embodiment, 8 sets of cyclones 56 are positioned within the interior of the upper portion 58 of the vessel 30 to dedust the product effluent stream, lift gas and steam before being withdrawn and discharged through a gas outlet 60 located along the rounded, concave top 62 of vessel 30. Each of the cyclones 56 has an upper gas inlet 63 that receives liberated hydrocarbons, lift gas and steam contained in the upper portion 58 of vessel 30, and has a cyclone riser pipe 64 which extends downwardly into the staged fluidized bed and terminates in a lower gas inlet 66 for inflow of influent liberated hydrocarbons and steam contained in the lower portion 38 of vessel 30. While cyclones 56 are preferably located within the interior of vessel 30, it may be desirable in some circumstances to position the cyclones outside of vessel 30. The liberated hydrocarbons, lift gas and steam withdrawn from vessel 30 are processed downstream by means well known in the art such as in a fractionating column (fractionator), quench tower, condenser or scrubber or multiples thereof to separate the heavy, middle and light oils and gases for subsequent upgrading in a catalytic cracker or hydrotreater. In the preferred embodiment, at least some of the light gases are recycled into the lift gas injector pipe 26 for use as part or all of the lift gas.

The retorted oil shale particles and the heat carrier material are discharged through solids discharge outlet 40 at the bottom of the solids-containing vessel 30 and are conveyed through a solids discharge pipe 68 by gravity flow into the bottom inlet end of an upright, dilute phase combustor lift pipe 70. The lower end of solids discharge pipe 68 has an L valve 72 through which air can be injected to help transport the discharged, retorted oil shale particles and heat carrier material into combustor lift pipe 70.

Air is injected into the bottom of combustor lift pipe 70 through air injector inlet 74 at a pressure from 20 to 80 psig, preferably from 30 to 40 psig, and at an upward velocity of 20 to 75 ft/sec., preferably from 30 to 50 ft/sec. to fluidize, entrain, and convey the discharged, retorted oil shale particles and heat carrier material upwardly through combustor lift pipe 70 into a combustor vessel 76. The temperature in combustor lift pipe 70 is from 1000° F. to 1400° F. and the residence time of the retorted oil shale particles, heat carrier material and air in combustor lift pipe 70 is from 2 to 10 seconds and preferably from 5 to 8 seconds. The carbon residue contained in the retorted oil shale particles is partially combusted in combustor lift pipe 70.

Combustor lift pipe 70 extends upwardly into the interior of combustor vessel 76 and has an outlet 78 at its top end positioned slightly below a conical baffle 80. Baffle 80 has downwardly diverging wall portion 82 as well as an optional annular skirt 84 to deflect and direct the flow of retorted oil shale particles, heat carrier material and air into the lower portion 86 of combustor vessel 76. The ratio of the maximum cross-sectional area of combustor vessel 76 to the maximum cross-sectional area of combustor lift pipe 70 taken in a widthwise (horizontal) direction, transverse to the upward flow of air, is from 2:1 to 10:1 and preferably 5:1.

Combustion of the retorted oil shale particles is completed in combustor vessel 76. In combustor vessel 76, the retorted oil shale particles, heat carrier material and air are at a temperature from 1000° F. to 1400° F. at a residence time from 1 minute to 10 minutes, and preferably not greater than 3 minutes.

The bottom 88 of combustor vessel 76 slopes downwardly to facilitate the downward gravity flow of combusted oil shale particles and heat carrier material into the lower portion 86 of combustor vessel 76. Bottom 88 of combustor vessel 76 is welded or otherwise secured to an upper portion of combustor lift pipe 70 and has a centrally disposed, combustor lift pipe-receiving opening 90 through which the combustor lift pipe 70 extends.

The combusted oil shale particles and heat carrier material are discharged through an outlet 92 in the bottom of combustor vessel 76 and are conveyed by gravity flow through heat carrier pipe 24 into mixing chamber 20. The lower end of heat carrier pipe 24 has an L valve 94 through which a fluid, such as the lift gas, can be injected to help transport the combusted oil shale particles and heat carrier material into mixing chamber 20. In the preferred embodiment, oil shale particles that have been combusted in combustor vessel 76 provide the heat carrier material for the system. Sand can also be added as additional heat carrier material if necessary.

Combustor vessel 76 also has an overflow discharge outlet 96 at its bottom to withdraw excess combusted oil shale particles and heat carrier material that have accumulated in the bottom of the combustor vessel. Shutoff valve 98 controls the rate of withdrawl.

The carbon contained in the retorted oil shale particles is burnt off mainly as carbon dioxide during combustion in the combustor lift pipe 70 and combustor vessel 76 and together with the air and other products of combustion forms combustion gases which are contained in the upper portion 100 of combustor vessel 76 and subsequently dedusted. In the preferred embodiment, the combustion gases are dedusted by a cyclone 102 located in the interior of combustor vessel 76. Cyclone 102 has an upper inlet 104 in the upper portion 100 of combustor vessel 76 and a lower inlet 106 at the bottom of a riser pipe 108 in the lower portion 86 of combustor vessel 76. Dedusted combustion gases are discharged through combustion gas outlet 110 along the curved, concave top 112 of combustor vessel 76 to an electrostatic precipitator 114 for further dedusting. The dedusted combustion gases can be discharged to the atmosphere or processed further for energy recovery, such as to produce steam for steam injectors 48 and 49 or a steam turbine.

In the illustrated embodiment, the main body portions of the mixing chamber 20, solids-containing vessel 30 and combustor vessel 76, as well as lift pipes 28 and 70, have a circular cross-section. Other cross-sectional configurations can also be used.

In the embodiment of FIG. 2, a series of lift gas injection nozzles 126 are used in lieu of a single lift gas injector 26 to provide an even better mixing pattern in the mixing chamber. Lift gas injection nozzles 126 can be arranged to provide a spouted bed in the mixing chamber.

Among the many advantages of the above retorting process and system are:

1. Improved product yield.
2. Reduced thermal cracking of condensable hydrocarbons.
3. Greater throughput.
4. Lower retorting time.
5. Reduced downtime.
6. Avoidance of moving parts in the retorting zones.
7. Fewer repairs and malfunctions.
8. Longer useful life.
9. Greater economy.

While the apparatus described in the system is particularly useful for retorting oil shale and other solid hydrocarbon-containing materials in accordance with the above process, it may be desirable in some circumstances to use the system for catalytic cracking of oil or processing other feedstocks.

Although embodiments of this invention have been shown and described, it is to be understood that various modifications and substitutions, as well as rearrangement of parts and combination of process steps, can be made by those skilled in the art without departing from the novel spirit and scope of this invention.

What is claimed is:

1. A fluid bed process for use in producing synthetic fuels, comprising the steps of:

commencing retorting of raw solid, hydrocarbon-containing material selected from the group consisting of oil shale, tar sands, uintaite, lignite and peat in a mixing chamber having a maximum transverse cross-sectional area substantially greater than the maximum transverse cross-sectional area of a vertical lift pipe extending substantially vertically above said mixing chamber by feeding said raw solid, hydrocarbon-containing material and substantially completely combusted solid heat carrier material into said mixing chamber through separate feed lines and injecting a fluidizing lift gas into said mixing chamber separately from said combusted material, in the absence of a sufficient amount of air and molecular oxygen to support combustion, to fluidize and mix said raw and combusted material in said mixing chamber;

continuing retorting and fluidizing of said raw solid, hydrocarbon-containing material with said substantially completely combusted material and said fluidizing lift gas in said lift pipe located in vertical alignment above said mixing chamber; and substantially completing retorting of said solid, hydrocarbon-containing material with said substantially completely combusted material in an overhead solids-containing vessel positioned in vertical and coaxial alignment above said lift pipe and said mixing chamber.

2. A fluid bed process in accordance with claim 1 further including controlling the retorting time in said mixing chamber and said lift pipe by transporting said raw solid-hydrocarbon material and said substantially completely combusted material generally upwardly through said mixing chamber with said fluidizing lift gas at a first selected flow velocity and generally upwardly through said lift pipe at a faster second selected flow velocity, and wherein said retorting is substantially completed in a solids-containing vessel having a maximum transverse cross-sectional area substantially greater than the maximum transverse cross-sectional area of said mixing chamber.

3. A fluid bed process for retorting oil shale for use in producing synthetic fuels, comprising the steps of:

feeding raw fluidizable oil shale into a mixing chamber having a maximum transverse cross-sectional area substantially greater than the maximum transverse cross-sectional area of a vertical lift pipe extending substantially vertically above said mixing chamber;

feeding fluidizable substantially combusted spent oil shale into said mixing chamber;

heating said fluidizable raw oil shale in said mixing chamber by contacting said raw oil shale with said substantially combusted spent oil shale fed into said mixing chamber at a temperature sufficient to liberate shale oil and light hydrocarbon gases from said raw oil shale without decomposing a substantial amount of carbonates;

fluidizing and mixing said raw and substantially combusted shale in said mixing chamber by injecting a fluidizing lift gas into said mixing chamber separately from said shale at a pressure and flow rate sufficient to transport said raw and combusted shale, shale oil and light hydrocarbon gases generally upward through said mixing chamber to said lift pipe for a sufficient residence time to partially retort said raw oil shale in said mixing chamber while minimizing cracking of said shale oil and light hydrocarbon gases emitted therefrom;

conveying said shale and said liberated shale oil and light hydrocarbon gases generally upwardly through said lift pipe to an overhead solids-containing vessel positioned in vertical alignment above said lift pipe with said fluidizing lift gas for a sufficient residence time to continue retorting of said row oil shale while minimizing cracking of said shale oil and light hydrocarbon gases;

moving said conveyed shale generally downwardly in said solids-containing vessel to a solids discharge outlet by gravity flow for a sufficient residence time to substantially complete retorting of said raw oil shale while minimizing cracking of said liberated shale oil and light hydrocarbon gases;

substantially preventing combustion of said raw oil shale, shale oil and light hydrocarbon gases in said mixing chamber, lift pipe and vessel by substantially preventing air from entering therein;

withdrawing said shale oil and gases from an upper portion of said solids-containing vessel;

discharging said shale from said solids discharge outlet;

transporting said discharged shale to the bottom portion of a combustor lift pipe;

combusting, fluidizing and carrying said discharged shale generally upwardly in said combustor lift pipe with air to a combustor vessel positioned in vertical alignment above said combustor lift pipe;

substantially completing combustion of said discharged shale in said combustor vessel;

withdrawing combustion gases from said combustor vessel;

removing said combusted shale from said combustor vessel; and feeding said combusted shale to said mixing chamber.

4. A fluid bed process in accordance with claim 3 further including the step of baffling said shale in said solids-containing vessel to facilitate downward movement and help minimize backmixing of said shale.

5. A fluid bed process in accordance with claim 3 including recycling said light hydrocarbon gas from said solids-containing vessel to said mixing chamber for use as said fluidizing lift gas.

6. A fluid bed process in accordance with claim 3 wherein said fluidizing lift gas includes from about 10% to about 30% by weight carbon dioxide to help suppress carbonate decomposition during retorting.

7. A fluid bed process in accordance with claim 3 including forming a spouted bed in said mixing chamber with said fluidizing lift gas.

8. A fluid bed process for retorting oil shale, comprising the steps of:

feeding fluidizable raw oil shale particles between ambient temperature and 700° F. into a mixing chamber having a maximum transverse cross-sectional area substantially greater than the maximum transverse cross-sectional area of a vertical lift pipe extending substantially vertically above said mixing chamber;

feeding fluidizable, substantially completely combusted spent oil shale at a temperature from 1000° F. to 1400° F. into said mixing chamber at a solids flux flow rate ratio of combusted oil shale to raw oil shale from 3:1 to 10:1;

fluidizing and mixing said combusted oil shale and said raw oil shale in said mixing chamber at a temperature from 900° F. to 1200° F. for a sufficient time to partially retort said raw oil shale in said mixing chamber without cracking a substantial proportion of said shale oil and light hydrocarbon gases emitted therefrom by injecting a fluidizing lift gas in the absence of air and molecular oxygen at a pressure from 30 psig to 100 psig, between ambient temperature and 1000° F., into said mixing chamber to transport and entrain said shale generally upwardly through said mixing chamber at a velocity of 2 ft/sec to 4.5 ft/sec into said lift pipe, said gas having a residence time in said mixing chamber of 0.5 seconds to 5 seconds, said mixing chamber being maintained at a pressure of 30 psig to 50 psig;

conveying said shale oil and said shale generally upwardly through said lift pipe at a solids density of 3 $lbs/ft^3$ to 20 $lbs/ft^3$ with said gases to an overhead solids-containing vessel positioned in vertical and coaxial alignment with and above said vertical lift pipe and said mixing chamber and having a transverse cross-sectional area from 5 to 10 times greater than said mixing chamber to continue retorting said raw oil shale in said lift pipe without cracking a substantial proportion of the liberated shale oil and light hydrocarbon gases;

gravitating said shale generally downwardly in said solids-containing vessel to a solids discharge outlet to substantially complete retorting of said raw oil shale in said solids-containing vessel without cracking a substantial proportion of the liberated shale oil and light hydrocarbon gases;

withdrawing said shale oil and gases from an upper portion of said solids-containing vessel;

discharging said shale from said solids outlet to a combustor; and substantially completely combusting said shale in a combustor.

9. A fluid bed process in accordance with claim 8 wherein said raw oil shale is fed into said mixing chamber at a temperature from 250° F. to 600° F. and said completely combusted shale is fed into said mixing chamber at a temperature from 1100° F. to 1300° F.

10. A fluid bed process in accordance with claim 8 wherein said raw oil shale is fed into said mixing chamber at a temperature from 300° F. to 400° F. and said completely combusted shale is fed into said mixing chamber at a temperature from 1150° F. to 1250° F.

11. A fluid bed process in accordance with claim 8 where at least some of said light hydrocarbon gases are recycled from said solids-containing vessel to said mixing chamber and used for at least a portion of said fluidizing lift gas.

12. A fluid bed process in accordance with claim 8 wherein said shale is combusted by:

moving said discharged shale by gravity flow to the bottom portion of a combustor lift pipe injecting air into the bottom portion of said combustor lift pipe at a velocity of 20 ft/sec to 75 ft/sec and at a pressure from 20 psig to 80 psig;

partially burning carbon residue contained in said retorted oil shale in said combustor lift pipe at a temperature from 1000° F. to 1400° F.;

transporting and fluidizing said partially burnt shale with said air substantially vertically upwardly to a combustor vessel positioned generally vertically above said combustor lift pipe;

substantially completing combustion of the carbon residue contained in said oil shale in 1 minute to 10 minutes in said combustor vessel;

withdrawing combustion gases from an upper portion of said combustor vessel; and discharging said combusted oil shale by gravity flow from the lower portion of said combustor vessel to said mixing chamber.

* * * * *

UNITED STATES PATENT OFFICE
CERTIFICATE OF CORRECTION

Patent No. 4,404,083 Dated September 13, 1983

Inventor(s) VASALOS, IACOVOS A.

It is certified that error appears in the above-identified patent and that said Letters Patent are hereby corrected as shown below:

| Column | Line | | |
|---|---|---|---|
| 2 | 18 | "new" | should read ---raw--- |
| 3 | 10 | "yield" | should read ---yields--- |
| 12 | 51 | "row" | should read ---raw--- |

Signed and Sealed this

*Third* Day of *September 1985*

[SEAL]

*Attest:*

DONALD J. QUIGG

*Attesting Officer* *Acting Commissioner of Patents and Trademarks - Designate*